US011512430B2

(12) United States Patent
Enqvist

(10) Patent No.: US 11,512,430 B2
(45) Date of Patent: Nov. 29, 2022

(54) DRYER FABRIC WITH WARP YARNS OF MULTIPLE MATERIALS

(71) Applicant: Valmet Technologies Oy, Espoo (FI)

(72) Inventor: Rauno Enqvist, Espoo (FI)

(73) Assignee: VALMET TECHNOLOGIES OY, Espoo (FI)

( * ) Notice: Subject to any disclaimer, the term of this patent is extended or adjusted under 35 U.S.C. 154(b) by 291 days.

(21) Appl. No.: 17/062,321

(22) Filed: Oct. 2, 2020

(65) Prior Publication Data

US 2021/0102339 A1 Apr. 8, 2021

(30) Foreign Application Priority Data

Oct. 3, 2019 (FI) ..... 20195843

(51) Int. Cl.
*D21F 7/12* (2006.01)
*D21F 1/00* (2006.01)
(Continued)

(52) U.S. Cl.
CPC ..... *D21F 1/0027* (2013.01); *D03D 15/00* (2013.01); *D10B 2321/06* (2013.01);
(Continued)

(58) Field of Classification Search
CPC ..... D21F 1/0027; D21F 1/0054; D21F 5/00; D21F 7/00; D21F 1/0036; D21F 7/08; D03D 15/00; D03D 13/00; D10B 2321/06; D10B 2331/04; D10B 2331/301; D10B 2401/02; D10B 2401/04; D10B 2401/062; D10B 2331/061; D01F 1/10; D01F 6/92
See application file for complete search history.

(56) References Cited

U.S. PATENT DOCUMENTS 5,713,398 A * 2/1998 Josef ..... D21F 1/0027 139/425 A
5,776,313 A * 7/1998 Bakis ..... D03D 15/283 162/902

(Continued)

FOREIGN PATENT DOCUMENTS

CN 104611978 B 5/2017
WO 9506161 A2 3/1995

OTHER PUBLICATIONS

Finnish Patent and Registration Office Search Report for FI 20195843, dated Apr. 16, 2020.

*Primary Examiner* — Robert H Muromoto, Jr.
(74) *Attorney, Agent, or Firm* — Stiennon & Stiennon

(57) ABSTRACT

A dryer fabric has a weft of cross machine direction yarns (6) and a first warp of first machine direction yarns (5) and a second warp of second machine direction yarns (9). The yarns of the first warp are arranged above the yarns of the second warp on a first surface (FS) side. The first warp has primary yarns (51) of PPS or PK yarns whose breaking load remains substantially stable within 15 days in conditions where RH=100%, T=125° C. and p=2.3 bar; and secondary yarns (52) of PET with breaking loads which substantially decrease under the same conditions. At least every second yarn of the first warp is a secondary yarn (52). The secondary yarns (52) may be two out of three or three out of four of the first machine direction yarns (5). PET reduces cost and adds elasticity to the dryer fabric.

15 Claims, 6 Drawing Sheets

(51) Int. Cl.
*D03D 15/00* (2021.01)
*D03D 1/00* (2006.01)

(52) U.S. Cl.
CPC .... *D10B 2331/04* (2013.01); *D10B 2331/301* (2013.01); *D10B 2401/02* (2013.01); *D10B 2401/04* (2013.01); *D10B 2401/062* (2013.01)

(56) References Cited

U.S. PATENT DOCUMENTS

| | | | | |
|---|---|---|---|---|
| 6,742,548 | B2 * | 6/2004 | Enqvist | D21F 1/0027 139/425 A |
| 8,501,640 | B2 * | 8/2013 | Suzuki | C09J 7/21 442/151 |
| 9,169,599 | B2 * | 10/2015 | Taipale | D21F 1/0045 |
| 10,982,356 | B2 * | 4/2021 | Enqvist | D03D 1/02 |
| 11,234,878 | B2 * | 2/2022 | Montgomery | D03D 1/0017 |
| 2013/0187367 | A1 * | 7/2013 | Kim | D06N 3/045 28/165 |
| 2016/0145799 | A1 * | 5/2016 | Alias | D21F 7/12 162/358.2 |
| 2019/0060147 | A1 * | 2/2019 | Montgomery | A61G 7/057 |
| 2022/0104980 | A1 * | 4/2022 | Montgomery | D03D 15/283 |

* cited by examiner

DRYER FABRIC WITH WARP YARNS OF MULTIPLE MATERIALS

CROSS REFERENCES TO RELATED APPLICATIONS

This application claims priority on Finnish application No. FI 20195843, filed Oct. 3, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a dryer fabric. The dryer fabric has a longitudinal direction and a cross direction and a first surface and a second surface. When the dryer fabric is in use the first surface is in contact with the material web to be processed, such as a paper or pulp web. The second surface of the dryer fabric faces towards machine parts, such as rolls of a paper machine. The dryer fabric forms an endless rotating loop when it is in use. The dryer fabric is mainly used in a dryer section of a paper or pulp making machine.

The dryer fabric extends in the longitudinal direction from a first end to a second end and in the cross direction from a first edge to a second edge. The dryer fabric comprises a weft comprising cross machine direction yarns, a double warp and a first seam-forming counterpart at the first end and a second seam-forming counterpart at the second end. The double warp comprises a first warp and a second warp. The first warp comprises first machine direction yarns and the second warp comprises second machine direction yarns. The yarns of the first warp are arranged above the yarns of the second warp on the first surface side in the thickness direction of the dryer fabric. The first warp comprises primary yarns whose breaking load is substantially stable within 15 days in conditions where RH=100%, T=125° C. and p=2.3 bar.

Further, the dryer fabric comprises a first seam-forming counterpart at the first end and a second seam-forming counterpart at the second end.

Monofilaments, which maintain their breaking load substantially stable in hydrolytic conditions, are usually quite expensive. The monofilaments may be made, for example, of polyphenylene sulfide. The raw material gives superior properties to the dryer fabric but has high costs. It is also substantially nonelastic.

SUMMARY OF THE INVENTION

An object of the present invention is to provide a dryer fabric so as to overcome the above problems. The object of the invention is achieved by a dryer fabric which has a first warp with primary yarns and secondary yarns arranged in such a manner that at least every second yarn of the first warp is a secondary yarn, the secondary yarns having a breaking load that is initially higher than the breaking load of the primary yarns but the breaking load of the secondary yarns decrease within 15 days in conditions where RH=100%, T=125° C. and p=2.3 bar.

An advantage of the dryer fabric is that the superior properties of the dryer fabric are mainly maintained while the fabric is much less expensive. Another advantage is that the fabric possesses more elasticity that enhances the performance of the dryer fabric e.g. during a web-break or during a high pressure washing.

The double warp comprises a first warp and a second warp. The first warp comprises first machine direction yarns and the second warp comprises second machine direction yarns. The yarns of the first warp and the yarns of the second warp are arranged above the yarns of the second warp on the first surface side in the thickness direction of the dryer fabric. The yarns of the first warp may be directly above the yarns of the second warp but alternatively the yarns of the first warp may be shifted in the cross-direction of the fabric in respect of the yarns of the second warp.

At the first end of the dryer fabric there is a first end region and at the second end there is a second end region. In order to form loops to the ends of the fabric the first machine direction yarns may be woven back in the end regions. The end segments of the second machine direction yarns may be removed so that free spaces are formed in the locations where the yarns have been removed. The end segments of the first machine direction yarns may be looped back onto themselves and woven back in the free spaces.

At the first edge of the dryer fabric there is a first edge zone extending in the machine direction and at the second edge there is a second edge zone extending in the machine direction. The edge zones have a certain width in the cross-machine direction.

According to one alternative, the first machine direction yarns, which form the first surface side of the fabric, comprise primary yarns and secondary yarns. The primary yarns and the secondary yarns are preferably monofilaments. The breaking load of the primary yarns is substantially stable within 15 days in conditions where RH=100%, T=125° C. and p=2.3 bar. Substantially stable means in this context that the breaking load decreases at the most five percent compared to the initial breaking load of the primary yarns. The breaking load of the secondary yarns is initially higher than the breaking load of the primary yarns but the breaking load of the secondary yarns decrease within 15 days in conditions where RH=100%, T=125° C. and p=2.3 bar. The breaking load of the secondary yarns decreases more than five percent compared to the initial breaking load of the secondary yarns.

The breaking load of the yarns are tested by using speed of 100 mm/min in T=23° C. and RH=65%. Conditioning 24 hours in the same conditions precedes the test.

A device suitable for simulating hydrolytic conditions is an autoclave. Ageing in the autoclave shall be made in the same batch in order to get comparable results. Control samples shall also be in the same batch with the samples to be tested. A device suitable for testing the breaking load is e.g. Instron tensile strength tester. The same definitions, test methods and conditions mentioned above are also used in connection with the other alternatives described in this text The primary and the secondary yarns are preferably flat monofilaments. The flat monofilaments mean in this context monofilaments that have a width that is greater than their thickness and the monofilaments have substantially planar upper and lower surfaces.

When taking a look at the cross-section of the dryer fabric the secondary yarns may have a lower profile on the first surface side in the thickness direction of the dryer fabric compared to the primary yarns. In other words, when the dryer fabric is in use the primary yarns make a direct contact to the web to be processed, such as a paper or pulp web, and between the web and the secondary yarns there are air gaps.

In such a manner the less resistant secondary yarns are shielded from e.g. heat and wear.

The primary yarns may be polyphenylene sulfide (PPS) yarns, preferably monofilaments. The PPS yarns possess excellent heat and chemical resistance, high dimensional stability, low moisture absorption and high resistance to hydrolysis. The secondary yarns, preferably monofilaments, may be polyester (PET) yarns. The PET yarns possess restricted properties compared to the PPS yarns in many respects but they give extra elasticity to the dryer fabric. The PET yarns comprise polyethylene terephthalate. The PET yarns preferably comprise a chemical hydrolysis stabilizer for preventing degradation. The chemical hydrolysis stabilizer may be a carbodiimide compound, such as a cyclic carbodiimide compound, an aromatic polycarbodiimide, or a monomeric carbodiimide.

The cross-machine direction yarns may be made of the same material as the machine direction yarns.

According to another alternative the primary yarns may be polyketone (PK) yarns or yarns comprising polyketone. They are preferably monofilaments. The yarns comprising polyketone may comprise another polymer as a blend, or there may be a core/sheath structure. There may be a polyketone sheath and a core of another polymer. The secondary yarns may be polyester (PET) yarns, preferably monofilaments. The PET yarns possess restricted properties compared to the PK yarns in many respects, but they give extra elasticity to the dryer fabric. The PET yarns comprise polyethylene terephthalate. The PET yarns preferably comprise a chemical hydrolysis stabilizer for preventing degradation. The chemical hydrolysis stabilizer may be a carbodiimide compound, such as a cyclic carbodiimide compound, an aromatic polycarbodiimide, or a monomeric carbodiimide.

The first warp comprising first machine direction yarns, which are preferably monofilaments, may comprise alternately the primary yarns and secondary yarns but a primary yarn may also be e.g. every fourth yarn.

For example, the first warp comprising first machine direction yarns, which are preferably monofilaments, may comprise alternately the polyphenylene sulfide yarns or the polyketone yarns or yarns comprising polyketone, i.e. every other first machine direction yarn is a polyphenylene sulfide yarn or a polyketone yarn or a yarn comprising polyketone and every other first machine direction yarn is a polyester yarn. However, other proportions of the polyphenylene sulfide yarns or polyketone yarns or yarns comprising polyketone and polyester yarns are possible. For example, a polyphenylene sulfide yarn or a polyketone yarn or a yarn comprising polyketone may be e.g. every fourth yarn.

The cross-machine direction yarns may be made of the same material as the machine direction yarns.

The dryer fabric is due to be an endless loop in use. In order to form a seam, the first and second ends of the dryer fabric may be attached to each other by the loops which have been formed by looping back the first machine direction yarns, or the loops are utilized for fastening separate locking spirals in the both ends of the fabric. In both cases, the seam forming counterparts, i.e. the loops or the locking spirals, are fastened to each other in such a manner that individual loops of the first seam forming counterpart and individual loops of the second seam forming counterpart intermesh.

If the seam is made by the loops of the machine direction yarns a pin is inserted in a channel which has been formed by the intermeshing loops. If the seam is made by the locking spirals a pin is inserted in a channel, which has been formed by the intermeshing turns of the locking spirals. The locking spiral may be of polyether ether ketone (PEEK). The form of the locking spiral may be flattened, i.e. the spiral has a shorter dimension in the thickness direction of the dryer fabric and the upper and the lower surface of the turn of the spiral is substantially planar.

When the primary yarns and the secondary yarns alternate and the primary yarn is on top of the secondary yarn on the first side of the dryer fabric a turn of the locking spiral binds itself to loops of the dryer fabric in such a manner that it binds itself to both a primary yarn and a secondary yarn. The uppermost yarn is highly resistant to hydrolysis and the monofilament under the uppermost yarn backs up the durability of the joint between the weave and the locking spiral.

When the polyphenylene sulfide yarns or polyketone yarns or yarns comprising polyketone and the polyester yarns alternate and the PPS or PK yarn is on top of the PET yarn on the first surface side of the dryer fabric a turn of the locking spiral binds itself to loops of the dryer fabric in such a manner that it binds itself to both a PPS yarn or a PK yarn and a PET yarn. The uppermost PPS yarn or PK yarn is highly resistant to hydrolysis and the PET yarn under the highly resistant yarn backs up the durability of the joint between the weave and the locking spiral.

Another alternative to make a dryer fabric is to use two different high performance yarns, i.e. the first warp of the dryer fabric comprises primary yarns whose breaking load and elongation at break are substantially stable within 15 days in conditions where RH=100%, T=125° C. and p=2.3 bar, and the first warp of the dryer fabric comprises secondary yarns whose breaking load and elongation at break are substantially stable within 15 days in conditions where RH=100%, T=125° C. and p=2.3 bar in such a manner that the primary yarns are different from the secondary yarns. The above-mentioned conditions may be arranged in an autoclave. After the treatment in the autoclave the monofilaments are tested.

The primary yarns may be, for example, polyphenylene sulfide (PPS) yarns and the secondary yarns may be, for example, polyketone yarns (PK). The primary and secondary yarns are preferably monofilaments. The first warp comprising first machine direction yarns may comprise alternately the PPS and the PK yarns, i.e. every other first machine direction yarn is a PPS yarn and every other first machine direction yarn is a PK yarn. However, other proportions of the PPS and PK yarns are possible. For example, a PPS yarn may be e.g. every fourth yarn.

The second warp may comprise polyester (PET) yarns. They preferably comprise a chemical hydrolysis stabilizer for preventing degradation. The chemical hydrolysis stabilizer may be a carbodiimide compound, such as a cyclic carbodiimide compound, an aromatic polycarbodiimide, or a monomeric carbodiimide. One possible structure of the dryer fabric is described below.

The cross-machine direction yarns may be made of the same material as the machine direction yarns.

If the seam is made by the loops of the machine direction yarns a pin is inserted in a channel which has been formed by the intermeshing loops. If the seam is made by the locking spirals a pin is inserted in a channel, which has been formed by the intermeshing turns of the locking spirals. The locking spiral may be of polyether ether ketone (PEEK). The form of the locking spiral may be flattened, i.e. the spiral has a shorter dimension in the thickness direction of the dryer fabric and the upper and the lower surface of the turn of the spiral is substantially planar.

Still another alternative is to form the first warp of the dryer fabric from polyketone yarns (PK), i.e. the first warp of the dryer fabric comprises yarns of polyketone whose breaking load is substantially stable within 15 days in conditions where RH=100%, T=125° C. and p=2.3 bar. The second warp may comprise polyester (PET) yarns. The yarns of the first and second warps are preferably monofilaments. They preferably comprise a chemical hydrolysis stabilizer for preventing degradation. The chemical hydrolysis stabilizer may be a carbodiimide compound, such as a cyclic carbodiimide compound, an aromatic polycarbodiimide, or a monomeric carbodiimide.

The cross-machine direction yarns may be made of the same material as the machine direction yarns.

If the seam is made by the loops of the machine direction yarns a pin is inserted in a channel which has been formed by the intermeshing loops. If the seam is made by the locking spirals a pin is inserted in a channel, which has been formed by the intermeshing turns of the locking spirals. The locking spiral may be of polyether ether ketone (PEEK). The form of the locking spiral may be flattened, i.e. the spiral has a shorter dimension in the thickness direction of the dryer fabric and the upper and the lower surface of the turn of the spiral is substantially planar.

It is possible that the above-mentioned alternatives become materialized only in either of the edge zones and the rest of the machine direction yarns of the first warp may be secondary yarns. The above-mentioned alternatives may also become materialized in both edge zones and the machine direction yarns between the edge zones may be secondary yarns. The width of the first edge zone and the width of the second edge zone may be at the highest 500 mm, preferably at the highest 300 mm and more preferably at the highest 150 mm as from the respective edge of the dryer fabric. For example, every other machine direction yarn in the edge zone(s) may be a primary yarn and every other machine direction yarn may be a secondary yarn. The primary yarn may be a polyphenylene sulfide (PPS) yarn, or a polyketone (PK) yarn. The secondary yarn may be a polyester (PET) yarn, or a polyketone (PK) yarn. The machine direction yarns of the first warp outside the edge zone(s) and the machine direction yarns of the second warp may be polyester (PET) yarns. The cross-machine direction yarns may be made of the same material as the machine direction yarns.

All yarns or monofilaments described above in the different alternatives may comprise auxiliary components besides the polymer, such as fillers or the like. The same applies to the locking spirals.

The dryer fabric may have many alternative structures. For example, the dryer fabric may have a structure described below. The structure may be applied to every alternative described above.

The dryer fabric comprises a double warp, i.e. there are two warps one above the other. A first warp comprises first machine direction yarns and a second warp comprises second machine direction yarns. The yarns of the first warp are arranged above the yarns of the second warp. The first machine direction yarns of the first warp and the second machine direction yarns of the second warp may be flat yarns.

The yarns of the first warp may be at least partially offset in respect of the yarns of the second warp which means that at least part of the yarns of the first warp are shifted laterally in respect of the yarns of the second warp. However, it is possible that all yarns of the first warp are offset in respect of the yarns of the second warp. The warp cover of each warp is preferably from 75 to 95%.

The dryer fabric comprises a weft which comprises cross-machine direction yarns. The cross-machine direction yarns of the weft may be round yarns, i.e. their cross section is a circle, or they may be oval yarns, i.e. their cross section is oval. The cross-machine direction yarns are usually monofilaments.

The yarns of the first warp and the yarns of the weft bind themselves to each other according to a first predetermined pattern, and the yarns of the second warp and the yarns of the weft bind themselves to each other according to a second predetermined pattern.

The dryer fabric may have a granular texture on the first side of the dryer fabric. In other words, there are a lot of contact points on the first surface of the industrial textile but less contact area. The granular texture is achieved by short yarn floats. For example, the first predetermined pattern may be formed in such a manner that the yarns of the first warp and the yarns of the weft bind to each other so that the yarns of the first warp repeatedly pass over two yarns of the weft and under two yarns of the weft. The yarns of the first warp next to each other are arranged in such a manner that when a coincidentally selected warp yarn is under the weft yarns the warp yarn next to the coincidentally selected warp yarn is above the weft yarns. This results in the granular texture on the first surface, i.e. the surface of the textile looks like being covered by grains.

The second predetermined pattern may be formed in such a manner that the yarns of the second warp and the yarns of the weft bind to each other so that the yarns of the second warp repeatedly pass above one weft yarn and under three weft yarns. The yarns of the second warp next to each other are arranged in such a manner that when a coincidentally selected warp yarn is above the weft yarn the warp yarn next to the coincidentally selected warp yarn is above the second weft yarn as from the weft yarn above which the coincidentally selected warp yarn is, i.e. the weft yarn that is the second from the weft yarn above which the coincidentally selected warp yarn is. The weft yarn over which the yarn of the second warp passes is the second weft yarn over which the yarn of the first warp passes.

The structure of the dryer fabric is not limited to the above-mentioned bind or cross-sections of yarns. The description of the structure is only one example of how to manufacture the weave of the dryer fabric.

BRIEF DESCRIPTION OF THE DRAWINGS

In the following, the invention will be described in more detail by means of preferred embodiments with reference to the accompanying drawings.

DESCRIPTION OF THE PREFERRED EMBODIMENTS

Figure 1:
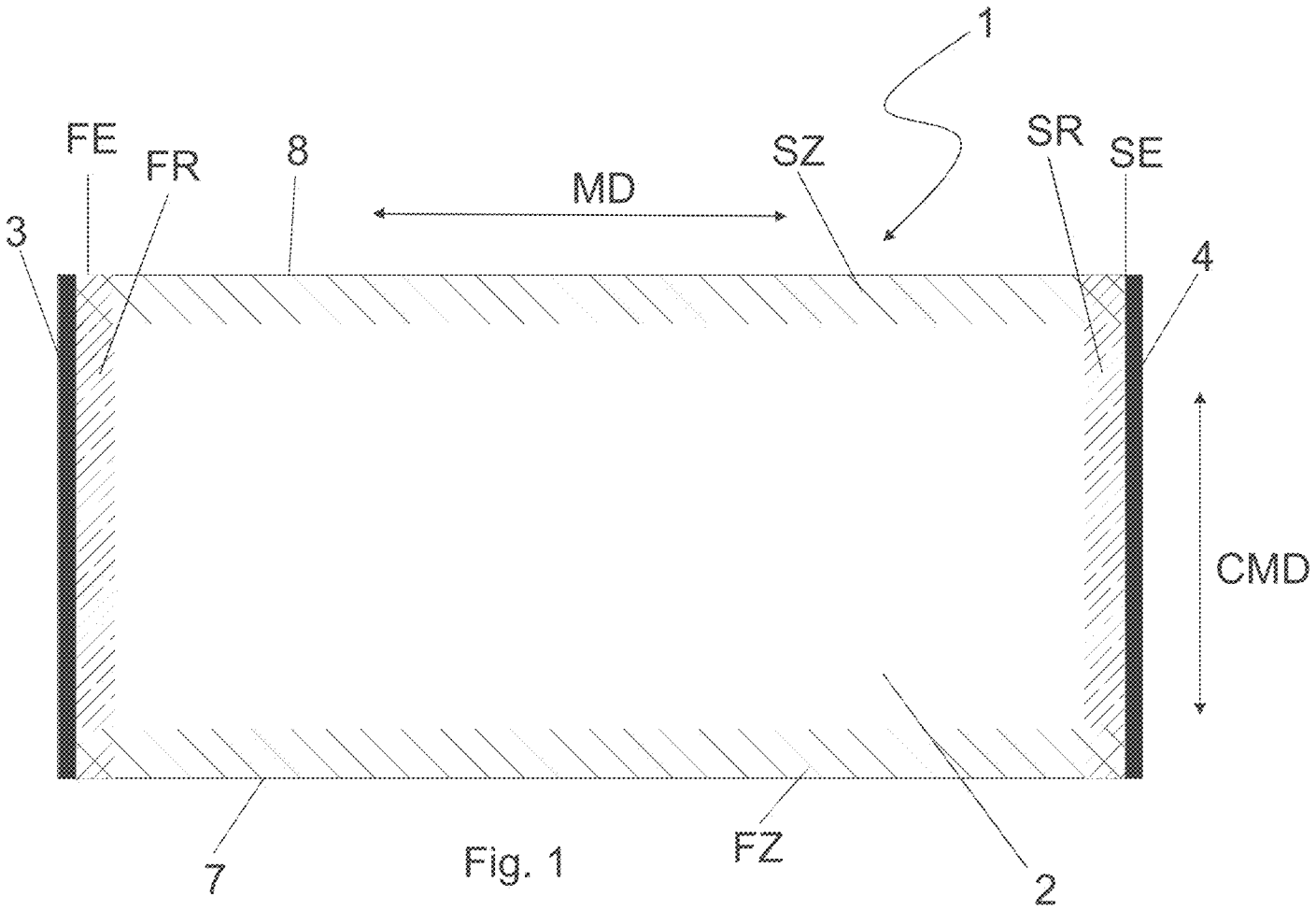
FIG. 1 shows a schematic top plan view of a dryer fabric.
Figure 2:
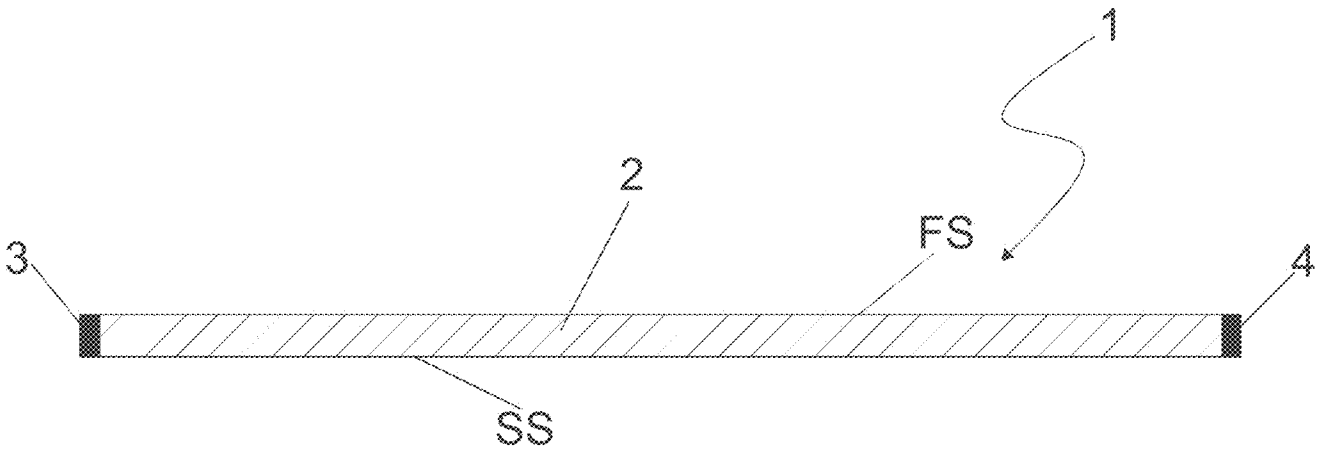
FIG. 2 shows a schematic side elevational view of a dryer fabric of FIG. 1 with ends not connected.
Figure 3:
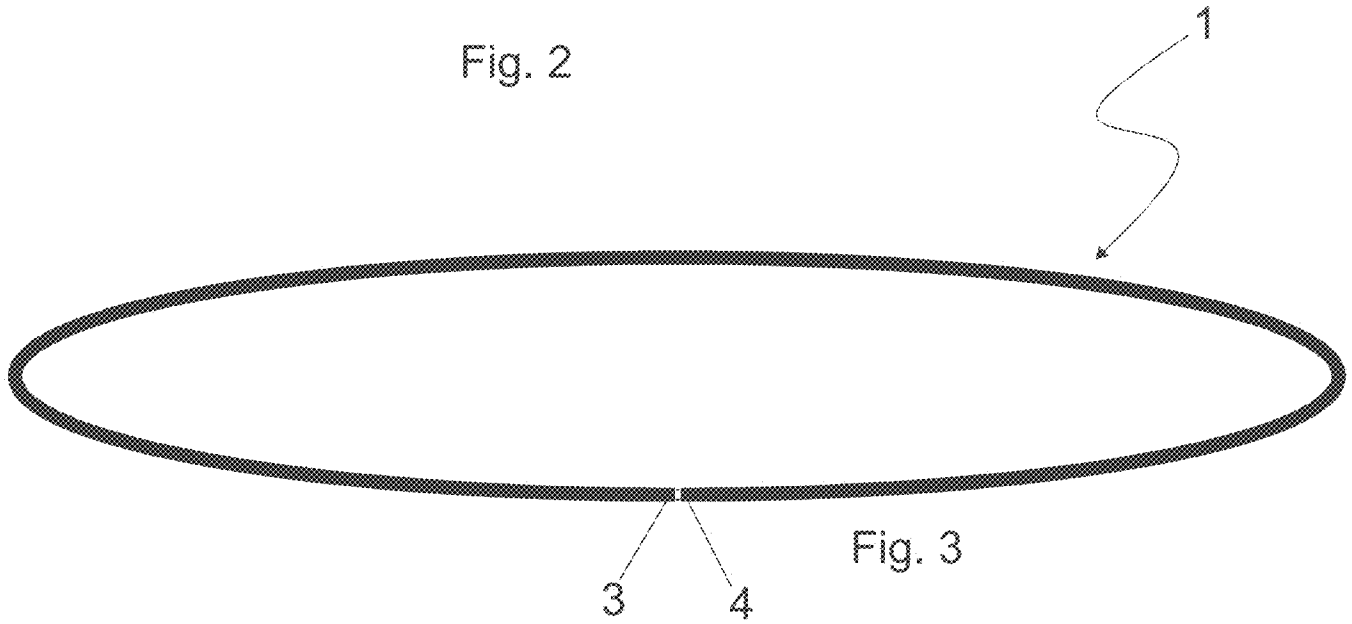
FIG. 3 shows a schematic side elevational view of a dryer fabric of FIG. 1 with ends connected.

FIGS. 1 to 3 show schematic views of a dryer fabric 1. The dryer fabric has a longitudinal direction MD, a cross direction CMD, a first surface FS and a second surface SS. The dryer fabric 1 comprises a weave 2 and a seam forming counterparts 3, 4. The weave 2 comprises a first end FE, a second end SE, a first end region FR, a second end region SR, a first edge 7, a second edge 8, a first edge zone FZ and a second edge zone SZ.

Besides the possible structures shown in other figures, one feasible structure is that every other machine direction yarn of the first warp in the first edge zone FZ, or every other machine direction yarn of the first warp in the second edge zone SZ may be a primary yarn and every other machine direction yarn may be a secondary yarn. It is also possible that both edge zones FZ, SZ have the above-mentioned structure. The primary yarn may be a polyphenylene sulfide (PPS) yarn, or a polyketone (PK) yarn. The secondary yarn may be a polyester (PET) yarn, or a polyketone (PK) yarn. The machine direction yarns of the first warp outside the edge zone(s) and the machine direction yarns of the second warp may be polyester (PET) yarns. The cross-machine direction yarns may be made of the same material as the machine direction yarns.

In use the dryer fabric 1 forms an endless loop as shown in FIG. 3. The seam forming counterparts 3, 4 are joined together by a pin (not shown).

Figure 4A:
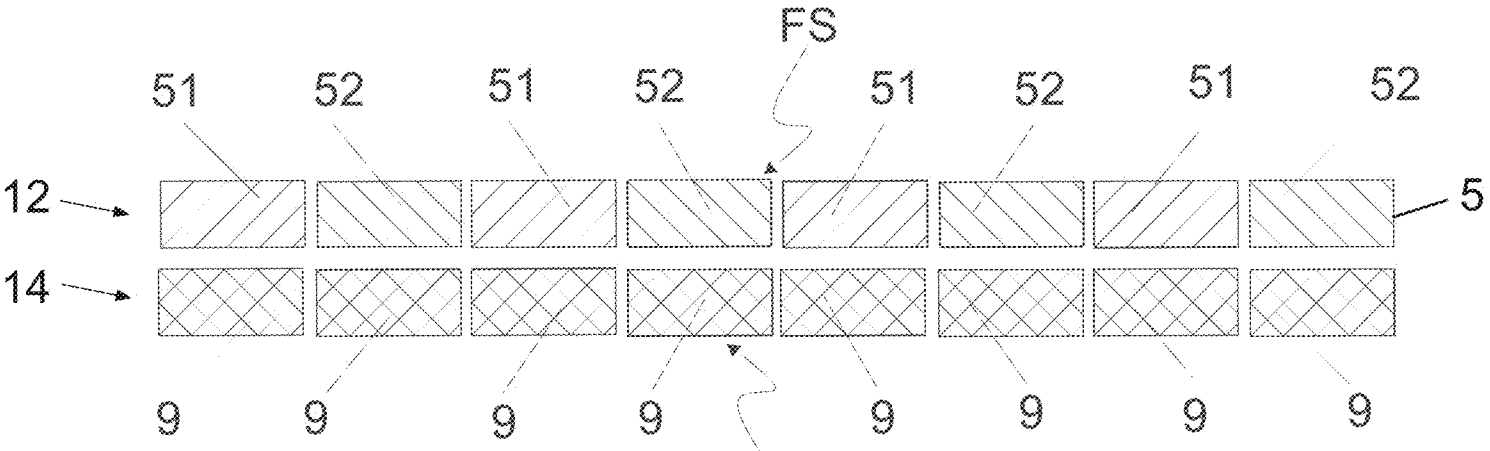
FIG. 4*a* shows a fragmentary schematic cross-sectional elevational view of a first embodiment of the dryer fabric of FIG. 1.
Figure 4B:
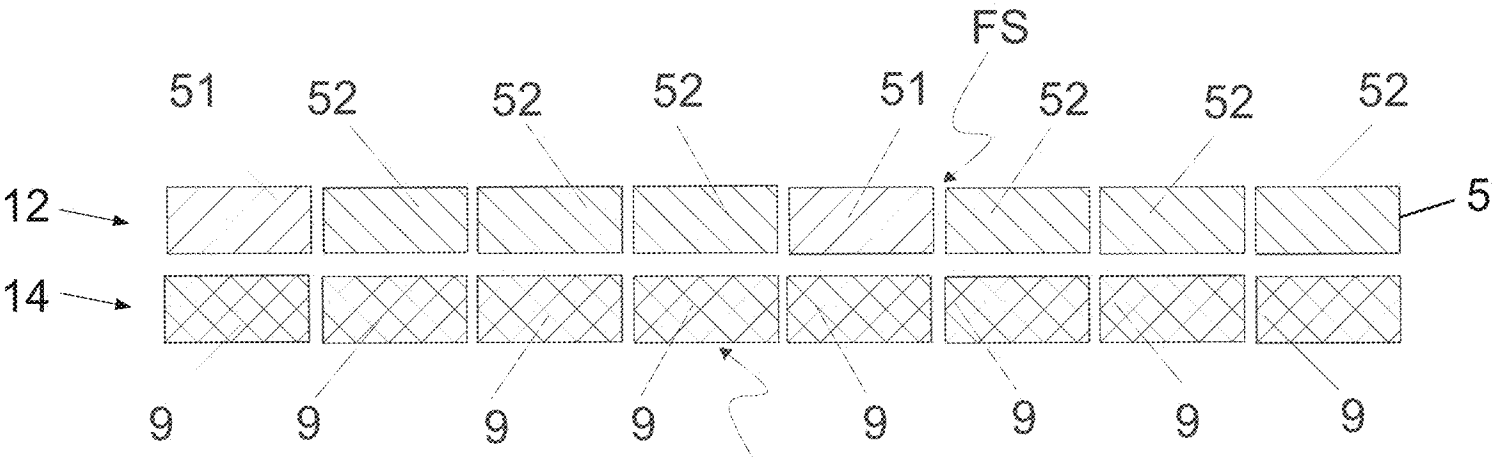
FIG. 4*b* shows a fragmentary schematic cross-sectional elevational view of a second embodiment of the dryer fabric of FIG. 1.

FIGS. 4*a* and 4*b* are schematic views of possible arrangements of the first and the second warps of a dryer fabric 1 as cross-sections. When the dryer fabric is in use the first surface FS is in contact with the material web to be processed, such as a paper or pulp web. The second surface SS of the dryer fabric faces towards machine parts, such as rolls of a paper machine.

The first warp 12 comprises primary yarns 51 and secondary yarns 52. The second warp 14 comprises yarns 9. In FIG. 4*a* the first warp comprises alternately a primary yarn 51 and a secondary yarn 52. In FIG. 4*b* every fourth first machine direction yarn is a primary yarn 51 and between two primary yarns 51 there are three secondary yarns 52.

FIGS. 4*a* and 4*b* show the yarns 51, 52 of the first warp directly above the yarns 9 of the second warp. However, the yarns 51, 52 of the first warp may be at least partially offset in respect of the yarns of the second warp which means that at least part of the yarns 51, 51 of the first warp are shifted laterally in respect of the yarns 9 of the second warp. It is possible that all yarns 51, 52 of the first warp are offset in respect of the yarns 9 of the second warp.

Figure 5:
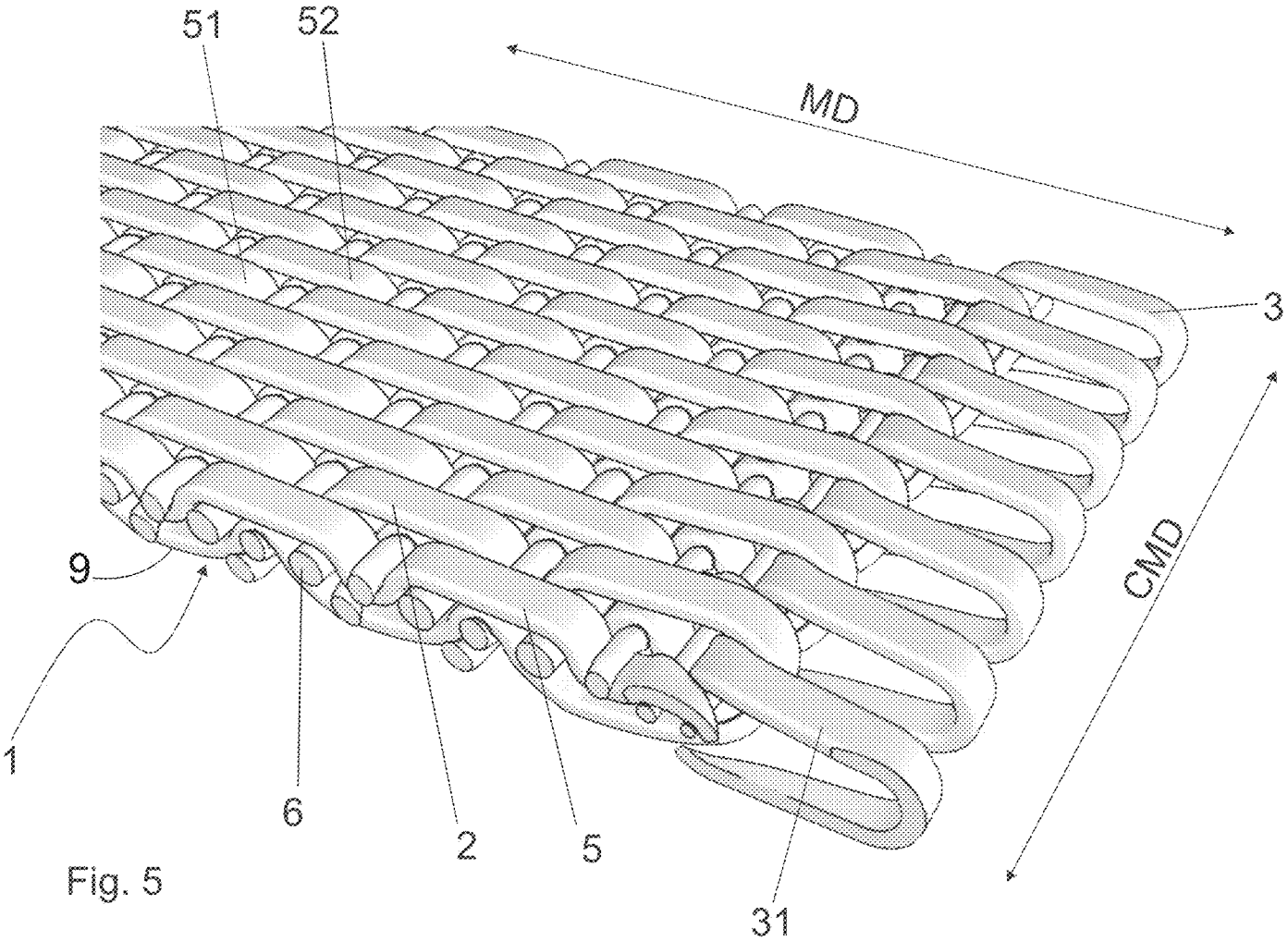
FIG. 5 shows a perspective view of a part of a dryer fabric.

FIG. 5 shows a perspective view of a part of a dryer fabric 1. The dryer fabric 1 comprises a weave 2 and seam forming counterparts 3, 4 (only counterpart 3 shown). The weave 2 comprises a first warp comprising first machine direction yarns 5, a second warp comprising second machine direction yarns 9 under the first warp and a weft comprising cross machine direction yarns 6.

The seam forming counterparts 3, 4 are locking spirals. As one can see from FIG. 5, the locking spiral is flattened, i.e. the spiral has the shortest dimension in the thickness direction of the dryer fabric and the upper and the lower surface of the turn of the spiral is substantially planar.

The first warp of the weave 2 comprises alternating primary monofilaments 51 and secondary monofilaments 52. The primary monofilament 51 is on top of the secondary monofilament 52 on the first surface side of the dryer fabric 1. A single turn 31 of the locking spiral binds itself to loops of the dryer fabric in such a manner that it binds itself to both the primary monofilament 51 and the secondary monofilament 52.

The hydrolysis resistance of the above-mentioned dryer fabric 1 was tested when the primary monofilaments were polyphenylene sulfide monofilaments and the secondary monofilaments were polyester monofilaments. Also, two comparative dryer fabrics were tested. The first comparative fabric was a fabric consisting of PPS yarns. The second comparative fabric was a fabric consisting of PET yarns. The breaking loads of the tested fabrics were in the beginning of the test over 90 N. After 15 days in the hydrolytic conditions the breaking load of the second comparative fabric was collapsed under 10 N while the breaking load of the dryer fabric 1 of the invention was on the same 90 N level as the breaking load of a comparative fabric consisting of PPS yarns.

Alternatively, the first warp of the weave 2 comprises alternating PK yarns 51 and PET yarns 52. The PK yarn 51 is on top of the PET yarn 52 on the first surface side of the dryer fabric 1. A single turn 31 of the locking spiral binds itself to loops of the dryer fabric in such a manner that it binds itself to both the PK yarn 51 and the PET yarn 52.

Figure 6:
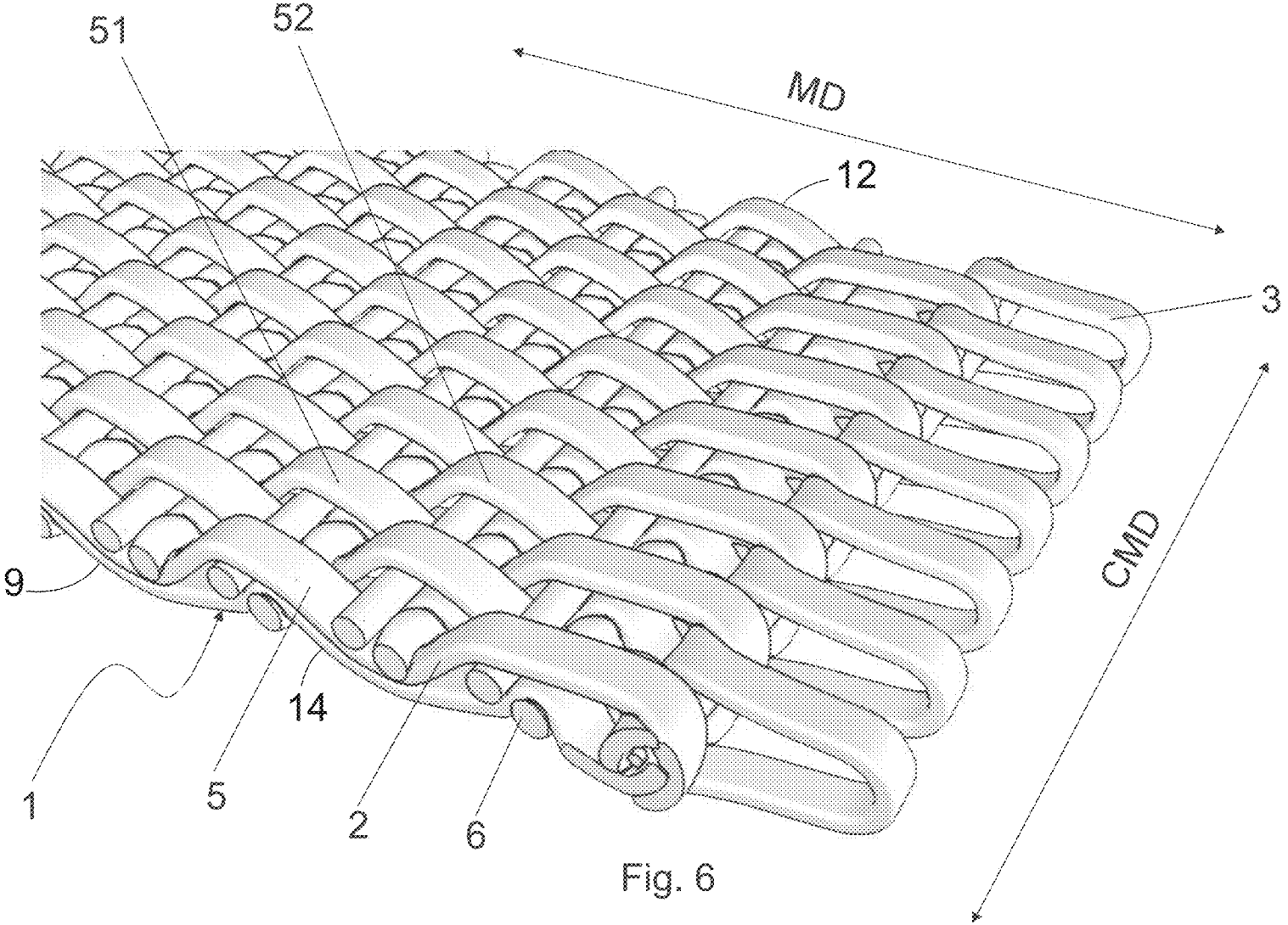
FIG. 6 shows another perspective view of a part of a dryer fabric.

FIG. 6 shows a perspective view of a part of a dryer fabric 1. The dryer fabric 1 comprises a weave 2 and seam forming counterparts 3, 4 (only counterpart 3 shown). The weave 2 comprises a first warp comprising first machine direction yarns 5, a second warp comprising second machine direction yarns 9 under the first warp and a weft comprising cross machine direction yarns 6.

The seam forming counterparts 3, 4 are loops of the first machine direction yarns. The first warp of the weave 2 comprises alternating PPS yarns 51 and PET yarns 52. The PPS yarn 51 is on top of the PET yarn 52 on the first surface side of the dryer fabric.

Alternatively, the first warp of the weave 2 comprises alternating PK yarns 51 and PET yarns 52. The PK yarn 51 is on top of the PET yarn 52 on the first surface side of the dryer fabric.

Figure 7:
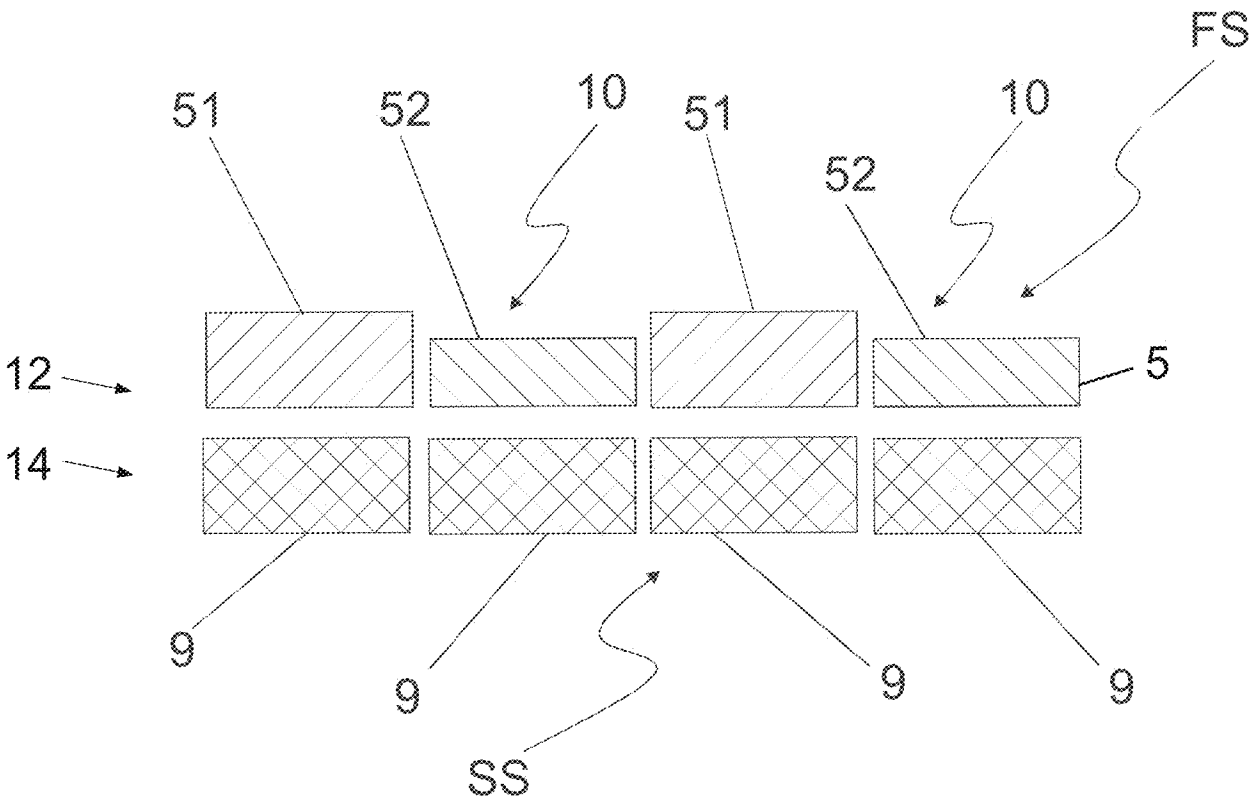
FIG. 7 shows a fragmentary schematic cross-sectional elevational view of the embodiment of the dryer fabric of FIG. 4*a* where the primary yarns of the first warp are thicker than the secondary yarns of the first warp.

FIG. 7 shows a schematic view of one possible arrangement of the first and the second warps of a dryer fabric 1 as a cross-section. The first warp comprises primary yarns 51 and secondary yarns 52. The second warp comprises yarns 9. The secondary yarns 52 may have a lower height in the thickness direction of the dryer fabric compared to the primary yarns 51. The secondary yarns 52 are on the same level with the primary yarns 51 on the second surface SS of the dryer fabric 1. In other words, when the dryer fabric is in use the primary yarns 51 make a direct contact to the web to be processed, such as a paper or pulp web, and between the web and the secondary yarns 52 on the first surface FS side there are air gaps 10. Thus, the secondary yarns 52 are shielded from e.g. heat and wear.

It should be understood that substantially stable means: largely, mainly, materially, for the most part or to a large extent stable.

It will be obvious to a person skilled in the art that, as the technology advances, the inventive concept can be implemented in various ways. The invention and its embodiments are not limited to the examples described above but may vary within the scope of the claims.

I claim:

1. A dryer fabric having a machine direction and a cross machine direction and a first surface for supporting a fiber web and a second surface for supporting the dryer fabric in a paper machine dryer section, the dryer fabric extending in the machine direction from a first end to a second end and in the cross machine direction from a first edge to a second edge, the dryer fabric comprising:

a weft comprising cross machine direction yarns;

a first warp comprising first machine direction yarns further comprising primary yarns and secondary yarns;

a second warp comprising second machine direction yarns;

wherein the yarns of the first warp form the first surface and are arranged above the yarns of the second warp in a thickness direction of the dryer fabric;

wherein the first warp primary yarns have a breaking load which remains substantially stable after 15 days exposure to conditions of relative humidity of 100%, temperature of 125° C., and at a pressure of 2.3 bar;

a first seam-forming counterpart at the first end and a second seam-forming counterpart at the second end;

wherein in the first warp, the secondary yarns are arranged so that the secondary yarns are at least every second yarn of the first warp; and wherein the secondary yarns have a breaking load that is initially, before being subjected to heat and humidity, higher than the breaking load of the primary yarns but the breaking load of the secondary yarns is less than the breaking load of the primary yarns when exposed to 15 days in conditions of relative humidity of 100%, temperature of 125° C. and at a pressure of 2.3 bar; and wherein the first warp secondary yarns are arranged so at least one secondary yarn is between the primary yarns and at least every second yarn of the first warp is a secondary yarn, and wherein the secondary yarns have a breaking load that is initially higher than the breaking load of the primary yarns (51) but the breaking load of the secondary yarns (52) decrease within 15 days in conditions of relative humidity of 100%, temperature of 125° C. and at a pressure of 2.3 bar.

2. The dryer fabric of claim 1 wherein the primary yarns comprise polyphenylene sulfide (PPS) yarns.

3. The dryer fabric of claim 1 wherein the primary yarns consist of polyphenylene sulfide (PPS) yarns.

4. The dryer fabric of claim 1 wherein the primary yarns comprise polyketone (PK) yarns.

5. The dryer fabric of claim 1 wherein the primary yarns consist of polyketone (PK) yarns.

6. The dryer fabric of claim 1 wherein the secondary yarns comprise polyester (PET) yarns.

7. The dryer fabric of claim 1 wherein the secondary yarns consist of polyester (PET) yarns.

8. The dryer fabric of claim 1 wherein the first warp comprises alternately a primary yarn and a secondary yarn.

9. The dryer fabric of claim 1 wherein the first seam-forming counterpart and the second seam-forming counterpart comprise a locking spiral comprising individual loops, wherein said locking spirals intermeshed and together with a pin being capable of forming a seam.

10. The dryer fabric of claim 9 wherein the individual loop of the each locking spiral is arranged to bind the adjacent primary yarns and secondary yarns in such a manner that the primary yarn is on top of the secondary yarn on the first side of the dryer fabric.

11. The dryer fabric of claim 9 wherein the locking spiral is of polyether ether ketone (PEEK).

12. The dryer fabric of claim 7 wherein the polyester (PET) yarns comprise an anti-hydrolysis agent that is a carbodiimide compound.

13. The dryer fabric of claim 12 wherein the carbodiimide compound is selected from a group consisting of cyclic carbodiimide compound, an aromatic polycarbodiimide, and a monomeric carbodiimide.

14. The dryer fabric of claim 1 wherein the yarns of the first warp and the yarns of the second warp are monofilaments.

15. The dryer fabric of claim 1 wherein at the first edge there is a first edge zone and at the second edge there is a second edge zone, and the first warp comprises secondary yarns in such a manner that at least every second yarn of the first warp in at least one edge zone is a secondary yarn and the rest of the machine direction yarns of the first warp are secondary yarns.

* * * * *